US009249668B2

(12) United States Patent
Fisk et al.

(10) Patent No.: US 9,249,668 B2
(45) Date of Patent: Feb. 2, 2016

(54) AIRFOIL WITH BREAK-WAY, FREE-FLOATING DAMPER MEMBER

(75) Inventors: Benjamin T. Fisk, East Granby, CT (US); Tracy A. Propheter-Hinckley, Manchester, CT (US); Gregory M. Dolansky, Higganum, CT (US); David P. Houston, Glastonbury, CT (US); Anita L. Tracy, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 1120 days.

(21) Appl. No.: 13/454,183

(22) Filed: Apr. 24, 2012

(65) Prior Publication Data

US 2013/0276455 A1 Oct. 24, 2013

(51) Int. Cl.
*F01D 5/16* (2006.01)

(52) U.S. Cl.
CPC ..... *F01D 5/16* (2013.01)

(58) Field of Classification Search
CPC ..... F01D 5/26; F01D 5/16; F01D 25/04; F01D 25/06; F05B 2260/96; F05B 2260/964
See application file for complete search history.

(56) References Cited

U.S. PATENT DOCUMENTS

| | | | | |
|---|---|---|---|---|
| 1,833,754 | A * | 11/1931 | Paget | 416/215 |
| 2,343,918 | A | 5/1943 | McCoy | |
| 2,828,941 | A * | 4/1958 | Foley | 416/231 R |
| 4,441,859 | A | 4/1984 | Sadler | |
| 4,484,859 | A * | 11/1984 | Pask et al. | 416/96 A |
| 4,815,939 | A | 3/1989 | Doble | |
| 5,038,014 | A | 8/1991 | Pratt et al. | |
| 5,165,860 | A | 11/1992 | Stoner et al. | |
| 5,558,497 | A | 9/1996 | Kraft et al. | |
| 5,837,960 | A * | 11/1998 | Lewis et al. | 219/121.63 |
| 6,391,251 | B1 | 5/2002 | Keicher et al. | |
| 6,669,447 | B2 | 12/2003 | Norris et al. | |
| 7,029,232 | B2 | 4/2006 | Tuffs et al. | |
| 7,033,140 | B2 * | 4/2006 | Gregg | 416/135 |
| 7,070,390 | B2 * | 7/2006 | Powell | 416/224 |
| 7,112,044 | B2 | 9/2006 | Whitehead et al. | |
| 7,121,800 | B2 | 10/2006 | Beattie | |
| 7,121,801 | B2 * | 10/2006 | Surace et al. | 416/193 A |
| 7,125,225 | B2 | 10/2006 | Surace et al. | |
| 7,217,093 | B2 | 5/2007 | Propheter et al. | |
| 7,270,517 | B2 | 9/2007 | Garner | |

(Continued)

FOREIGN PATENT DOCUMENTS

| | | |
|---|---|---|
| GB | 561897 | 6/1944 |

OTHER PUBLICATIONS

International Search Report and Written Opinion for International Application No. PCT/US2013/035939 completed on Jul. 22, 2013.

(Continued)

*Primary Examiner* — Dwayne J White
*Assistant Examiner* — William Grigos
(74) *Attorney, Agent, or Firm* — Carlson, Gaskey & Olds, P.C.

(57) ABSTRACT

An airfoil includes an airfoil body that has a leading edge and a trailing edge and a first sidewall and a second sidewall that is spaced apart from the first sidewall. The first sidewall and the second sidewall join the leading edge and the trailing edge and at least partially define a cavity in the airfoil body. A damper member is enclosed in the cavity and is free-floating within the cavity.

19 Claims, 5 Drawing Sheets

(56) References Cited

U.S. PATENT DOCUMENTS

| | | | |
|---|---|---|---|
| 7,478,994 | B2 | 1/2009 | Cunha et al. |
| 7,857,588 | B2 | 12/2010 | Propheter-Hinckley et al. |
| 2007/0253828 | A1 | 11/2007 | Masserey et al. |
| 2008/0290215 | A1 | 11/2008 | Udall et al. |
| 2008/0313899 | A1 | 12/2008 | Bauer et al. |
| 2009/0258168 | A1 | 10/2009 | Barcock et al. |
| 2009/0304497 | A1 | 12/2009 | Meier et al. |
| 2010/0232968 | A1* | 9/2010 | Miller ..... 416/190 |
| 2011/0048664 | A1 | 3/2011 | Kush et al. |

OTHER PUBLICATIONS

European Search Report for European Patent Application No. 13781623.7 completed Mar. 25, 2015.

* cited by examiner

AIRFOIL WITH BREAK-WAY, FREE-FLOATING DAMPER MEMBER

BACKGROUND

This disclosure relates to an airfoil, such as an airfoil for a gas turbine engine.

Turbine, fan and compressor airfoil structures are typically manufactured using die casting or die forging techniques. For example, the airfoil is cast within a mold that defines an exterior airfoil surface. A core structure may be used within the mold to form impingement holes, cooling passages, ribs or other structures within the airfoil. The die casting technique inherently limits the geometry, size, wall thickness and location of airfoil structures. Thus, the design of a traditional airfoil is limited to structures that can be manufactured using the die casting technique, which in turn may limit the performance of the airfoil.

SUMMARY

An airfoil according to an exemplary aspect of the present disclosure includes an airfoil body that has a leading edge and a trailing edge and a first side wall and a second side wall that is spaced apart from the first side wall. The first side wall and the second side wall join the leading edge and the trailing edge and at least partially define a cavity in the airfoil body. A damper member is enclosed in the cavity and is free-floating within the cavity.

In a further non-limiting embodiment of the above example, the damper member is elongated.

In a further non-limiting embodiment of any of the foregoing examples, the damper member has a geometric cross-sectional shape.

In a further non-limiting embodiment of any of the foregoing examples, the damper member includes a fractured surface at one end thereof.

In a further non-limiting embodiment of any of the foregoing examples, the damper member includes a terminal end and a narrow protuberance at the terminal end.

In a further non-limiting embodiment of any of the foregoing examples, the damper member includes a vestigial structure and the airfoil body includes a corresponding vestigial structure.

An airfoil according to an exemplary aspect of the present disclosure includes an airfoil body that has a leading edge and a trailing edge and a first side wall and a second side wall that is spaced apart from the first side wall. The first side wall and the second side wall join the leading edge and the trailing edge and at least partially define a cavity in the airfoil body. A damper member is enclosed in the cavity and is connected to the body in a break-away joint.

In a further non-limiting embodiment of any of the foregoing examples, the break-away joint has a minimum cross-sectional area and the damper member has a minimum cross-sectional area, and the minimum cross-sectional area of the break-away joint is less than a minimum cross-sectional area of the damper member.

In a further non-limiting embodiment of any of the foregoing examples, the minimum cross-sectional area of the break-away joint is less than a critical cross-sectional area needed to support the mass of the damper member during rotation of the airfoil body.

In a further non-limiting embodiment of any of the foregoing examples, the break-away joint is located at a terminal end of the damper member.

In a further non-limiting embodiment of any of the foregoing examples, the break-away joint is an exclusive connection between the damper member and the airfoil body.

In a further non-limiting embodiment of any of the foregoing examples, the damper member is free of any contact with the airfoil body, exclusive of the break-away joint.

A turbine engine according to an exemplary aspect of the present disclosure includes, optionally a fan, a compressor section, a combustor in fluid communication with the compressor section and a turbine section in fluid communication with the combustor. The turbine section is coupled to drive the compressor section and the fan. At least one of the fan, the compressor section and the turbine section includes an airfoil having an airfoil body. The airfoil body includes a leading edge and a trailing edge and a first side wall and a second side wall that is spaced apart from the first side wall. The first side wall and the second side wall join the leading edge and the trailing edge and at least partially define a cavity in the body. A damper member is enclosed in the cavity and is free-floating within the cavity.

In a further non-limiting embodiment of any of the foregoing examples, the damper member includes a fractured surface at one end thereof.

In a further non-limiting embodiment of any of the foregoing examples, the damper member includes a vestigial structure and the airfoil body includes a corresponding vestigial structure.

In a further non-limiting embodiment of any of the foregoing examples, the damper member is elongated.

In a further non-limiting embodiment of any of the foregoing examples, the damper member has a geometric cross-sectional shape.

A method for processing an airfoil according to an exemplary aspect of the present disclosure includes depositing multiple layers of a powdered metal onto one another, joining the layers to one another with reference to data relate to a particular cross-section of an airfoil, and producing the airfoil with an airfoil body including a leading edge and a trailing edge and a first side wall and a second side wall that is spaced apart from the first side wall. The first side wall and the second side wall join the leading edge and the trailing edge and at least partially define a cavity in the airfoil body. A damper member is enclosed in the cavity and is connected to the body in a break-away joint.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION OF THE PREFERRED EMBODIMENT

Figure 1:
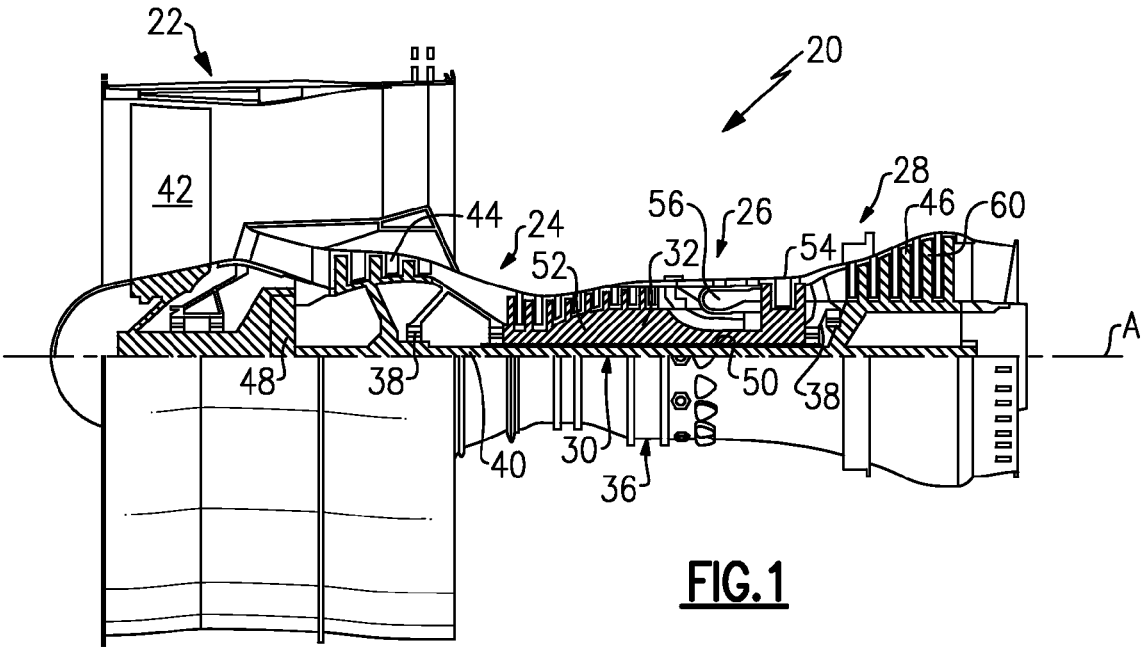
FIG. 1 shows an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including three-spool architectures.

The engine 20 generally includes a first spool 30 and a second spool 32 mounted for rotation about an engine central axis A relative to an engine static structure 36 via several bearing systems 38. It should be understood that various bearing systems 38 at various locations may alternatively or additionally be provided.

The first spool 30 generally includes a first shaft 40 that interconnects a fan 42, a first compressor 44 and a first turbine 46. The first shaft 40 may be connected to the fan 42 through a gear assembly of a fan drive gear system 48 to drive the fan 42 at a lower speed than the first spool 30. The second spool 32 includes a second shaft 50 that interconnects a second compressor 52 and second turbine 54. The first spool 30 runs at a relatively lower pressure than the second spool 32. It is to be understood that "low pressure" and "high pressure" or variations thereof as used herein are relative terms indicating that the high pressure is greater than the low pressure. An annular combustor 56 is arranged between the second compressor 52 and the second turbine 54. The first shaft 40 and the second shaft 50 are concentric and rotate via bearing systems 38 about the engine central axis A which is collinear with their longitudinal axes.

The core airflow is compressed by the first compressor 44 then the second compressor 52, mixed and burned with fuel in the annular combustor 56, then expanded over the second turbine 54 and first turbine 46. The first turbine 46 and the second turbine 54 rotationally drive, respectively, the first spool 30 and the second spool 32 in response to the expansion.

Figure 2:
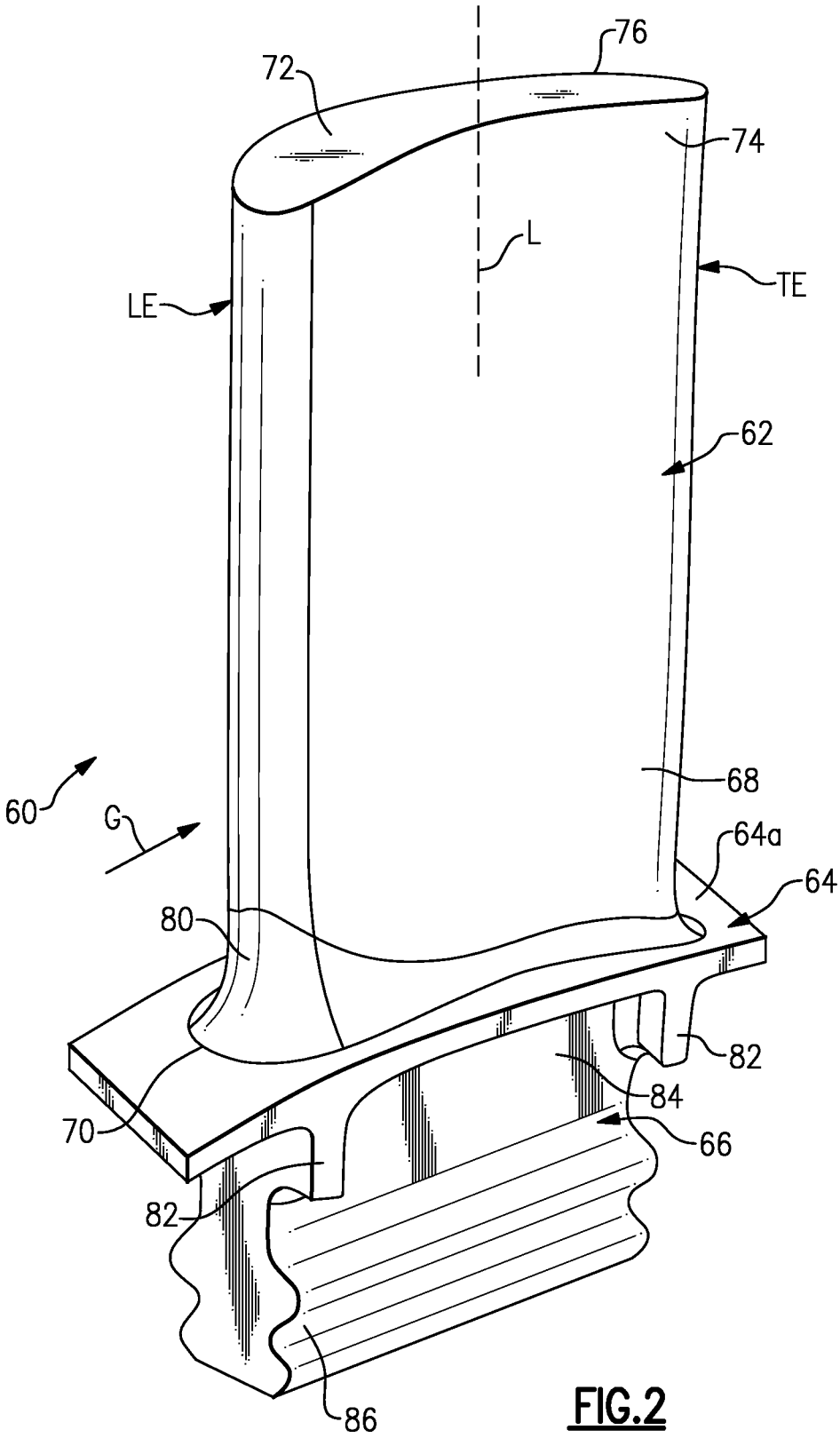
FIG. 2 shows a perspective view of an airfoil.

FIG. 2 illustrates an example airfoil 60. In this example, the airfoil 60 is a turbine blade of the turbine section 28. The airfoil 60 may be mounted on a turbine disk in a known manner with a plurality of like airfoils. Alternatively, it is to be understood that although the airfoil 60 is depicted as a turbine blade, the disclosure is not limited to turbine blades and the concepts disclosed herein are applicable to turbine vanes, compressor airfoils (blades or vanes) in the compressor section 24, fan airfoils in the fan section 22 or any other airfoil structures. Thus, some features that are particular to the illustrated turbine blade are to be considered optional.

The airfoil 60 includes an airfoil portion 62, a platform 64 and a root 66. The platform 64 and the root 66 are particular to the turbine blade and thus may differ in other airfoil structures or be excluded in other airfoil structures.

The airfoil 60 includes a body 68 that defines a longitudinal axis L between a base 70 at the platform 64 and a tip end 72. The longitudinal axis L in this example is perpendicular to the engine central axis A. The body 68 includes a leading edge (LE) and a trailing edge (TE) and a first side wall 74 (pressure side) and a second side wall 76 (suction side) that is spaced apart from the first side wall 74. The first side wall 74 and the second side wall 76 join the leading edge (LE) and the trailing edge (TE) and at least partially define a cavity 78 (FIG. 3) in the body 68.

The airfoil portion 62 connects to the platform 64 at a fillet 80. The platform 64 connects to the root 66 at buttresses 82. The root 66 generally includes a neck 84 and a serration portion 86 for securing the airfoil 60 in a disk.

It should be understood that relative positional terms such as "forward," "aft," "upper," "lower," "above," "below," "circumferential," "radial" and the like are with reference to the normal operational attitude and engine central axis A, unless otherwise indicated. Furthermore, with reference to the engine 20, the tip end 72 of the airfoil 60 is commonly referred to as the outer diameter of the airfoil 60 and the root 66 is commonly referred to as the inner diameter of the airfoil 60. The platform 64 includes an upper surface 64*a* that bounds an inner diameter of a gas path, generally shown as G, over the airfoil portion 62. Some airfoils may also include a platform at the tip end 72 that bounds an outer diameter of the gas path G.

Figure 3:
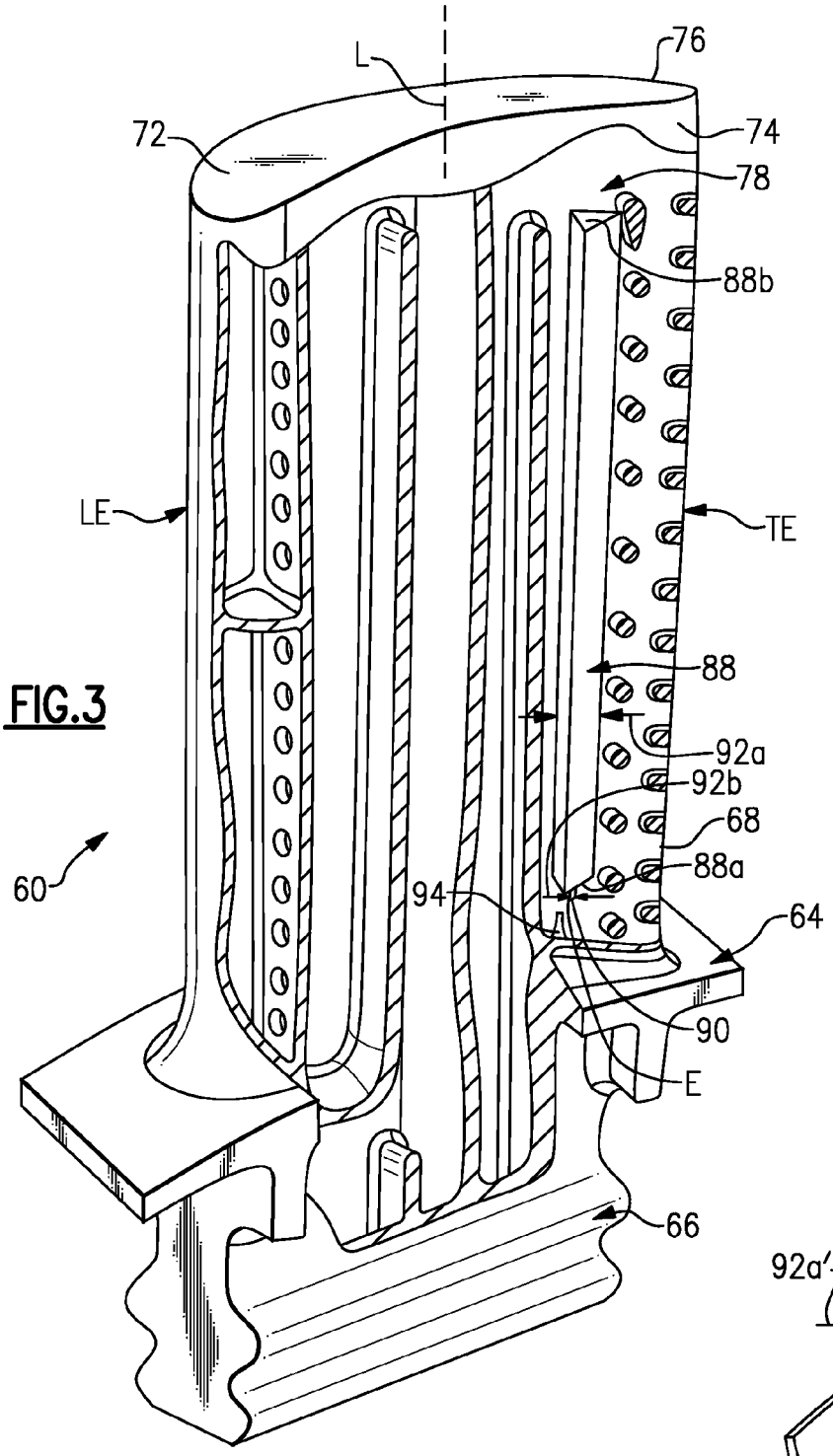
FIG. 3 shows the airfoil of FIG. 2 with a portion of a sidewall cutaway to reveal an interior cavity of the airfoil.

FIG. 3 shows the airfoil 60 with a portion of the first sidewall 74 cutaway to reveal the cavity 78 within the airfoil body 68. The airfoil 60 includes a damper member 88 enclosed in the cavity 78. The damper member 88 is free-floating within the cavity 78. The term "enclosed" or variations thereof as used in this disclosure refers to the damper member 88 being completely surrounded by the airfoil body 68 such that no portion of the damper member 88 extends outside of the cavity 78. The term "free-floating" as used in this disclosure refers to the damper member 88 being free of any rigid connections to the airfoil body 68. Thus, the damper member 88 is free to move within the confines of other structures within the cavity 78.

In this example, the damper member 88 is longitudinally elongated and has a uniform cross-section throughout its length, which extends between a first terminal end 88*a* and second terminal end 88*b*. As shown, the damper 88 has a rounded triangular cross-section taken perpendicular to the longitudinal axis L. It is to be understood, however, that other geometric shapes can also be used.

At the first terminal end 88*a* the damper member 88 includes a narrow protuberance 90 extending there from. In this example, the narrow protuberance 90 extends longitudinally. The narrow protuberance 90 is narrow relative to the remaining portion of the damper member 88, exclusive of the narrow protuberance 90. That is, the damper member 88 has a cross-sectional area represented at 92*a*, and the narrow protuberance 90 has a cross-sectional area as represented at 92*b* that is smaller than the cross-sectional area 92*a*. The cross-sectional areas 92*a* and 92*b* are the minimal cross-sectional areas of the damper member 88 (exclusive of the narrow protuberance 90) and narrow protuberance 90, respectively, as taken in a direction perpendicular to the longitudinal axis L.

A distal end E of the narrow protuberance 90 includes a fractured surface 90*a*. The term "fractured surface" or variations thereof as used herein refers to a surface having topological features that are characteristic of a break. By way of example, such topological features may be characteristic of a ductile break, a brittle break, or combination thereof and are macroscopically or microscopically distinguishable over manufactured surfaces, such as machined surfaces.

As will be described in more detail below, the narrow protuberance 90 is a vestigial structure and the airfoil body 68 includes a corresponding vestigial structure 94 that, at one time, was attached to the narrow protuberance 90. A "vestigial structure" is a structure that at one time served a particular purpose or function, but no longer serves, or is able to serve, that same purpose or function. The narrow protuberance 90 initially serves to rigidly connect the damper member 88 to the airfoil body 68 for manufacturing purposes, for example. However, upon use of the airfoil 60 in the engine 20, the narrow protuberance 90 fractures and releases the damper member 88 from connection to the airfoil body 68. Thus, after fracture, the narrow protuberance 90 no longer serves the purpose of connecting the damper member 88 to the airfoil body 68 and is thus a vestigial structure.

Figure 4B:
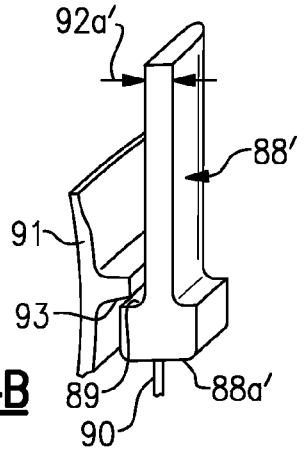
FIG. 4B shows a modified damper member.
Figure 4A:
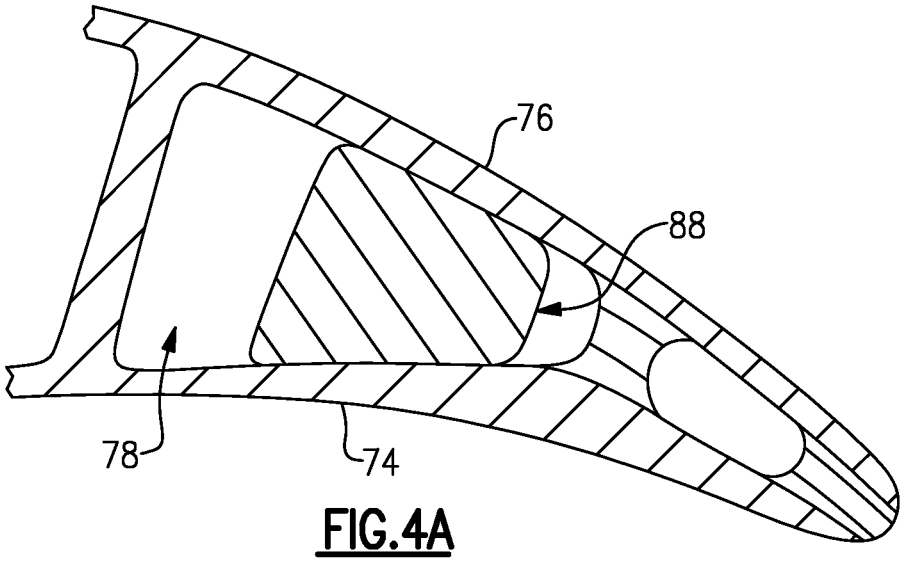
FIG. 4A shows a cross-section of a damper member in an operational condition in contact with sidewalls of an airfoil.

Referring to FIG. 4A, in operation, upon rotation of the airfoil 60 the damper member 88 is thrown longitudinally outwardly and contacts the first sidewall 74, the second sidewall 76, both sidewalls 74 and 76, and/or other structures within the cavity 78. The contact between the damper member 88 and the walls 74 or 76 or other structures causes friction that then removes energy from the system and thus reduces vibrations of the airfoil 60. As can be appreciated, the size and location of the damper member 88 can be adjusted in a design stage to provide dampening in a particular location of the airfoil 60 and/or to target specific vibrational modes and degree of dampening.

FIG. 4B shows a modified damper member 88'. In the example, the first terminal end 88*a*' of the damper member 88' is enlarged relative to the cross-sectional area represented at 92*a*' to provide a shelf 89. An adjacent wall 91 includes a corresponding shelf 93. In operation, upon rotation of the airfoil 60, the damper member 88' is thrown longitudinally outwardly such that the shelves 89 and 93 abut to limit outward movement of the damper member 88'. The shelves thereby limit loads on the damper member 88' and reduce or prevent buckling of the damper member 88'.

Figure 6:
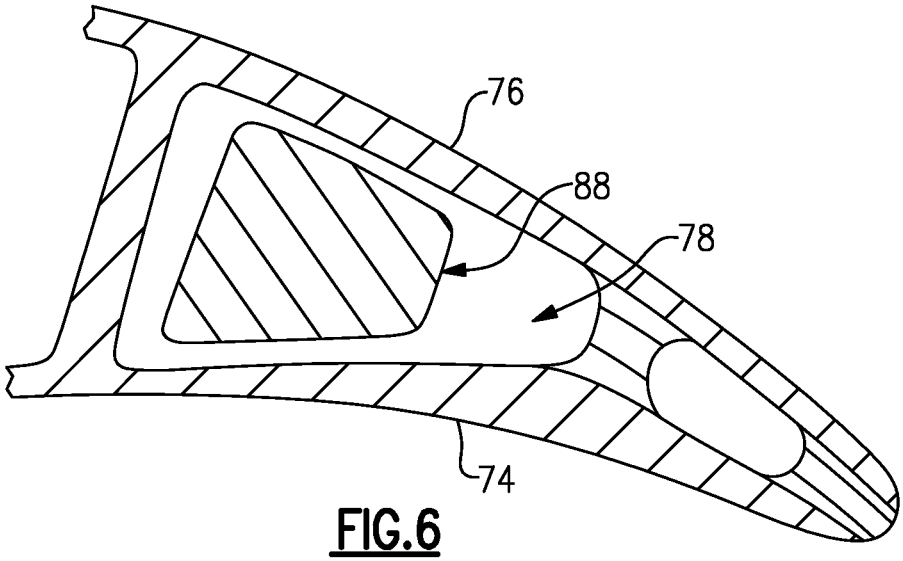
FIG. 6 shows a cross-section through a damper member and airfoil in an as-manufactured state.
Figure 5A:
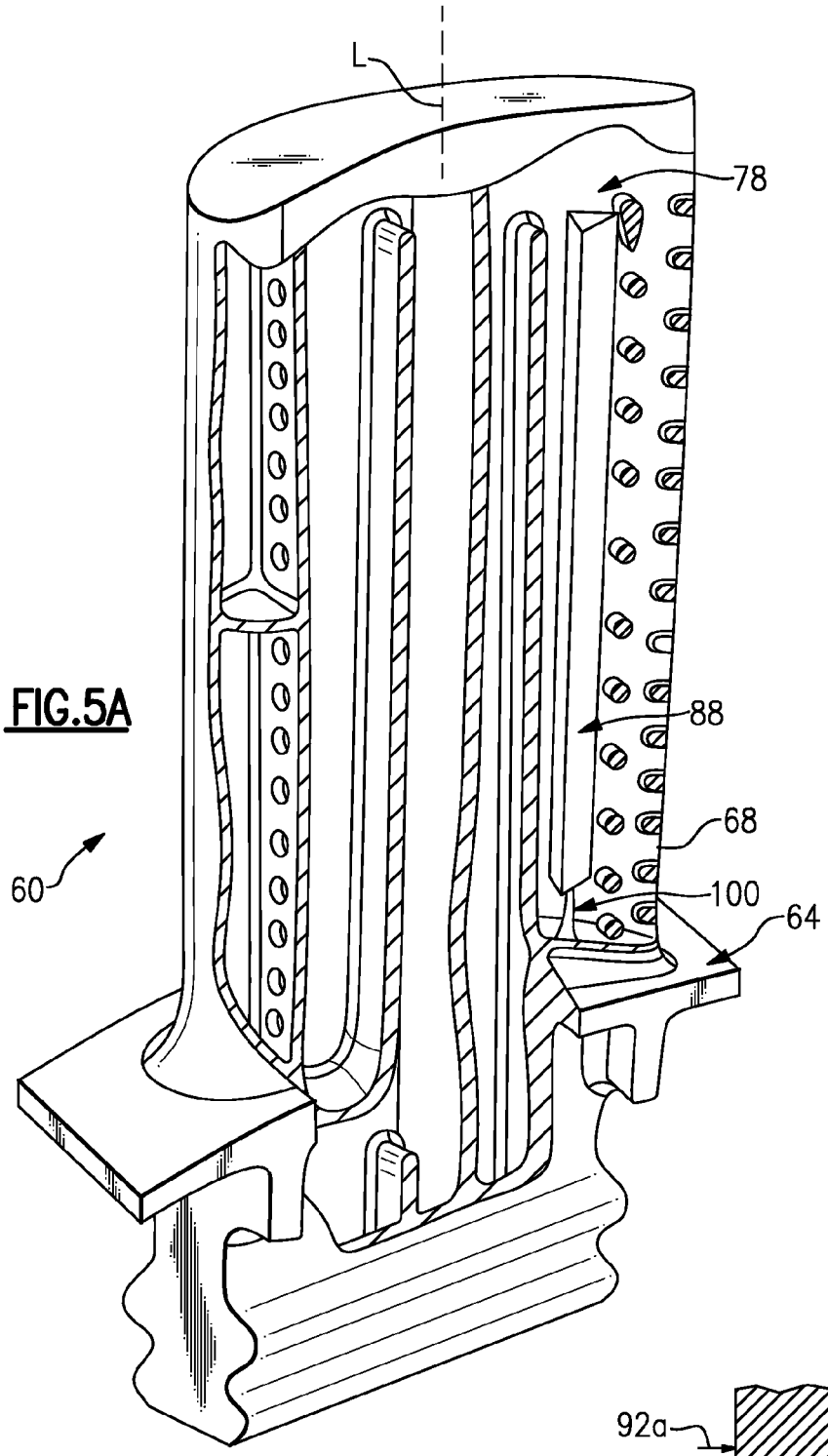
FIG. 5A shows a perspective view of an airfoil in an as-manufactured state with a portion of a sidewall cutaway to reveal an interior cavity of the airfoil.
Figure 5B:
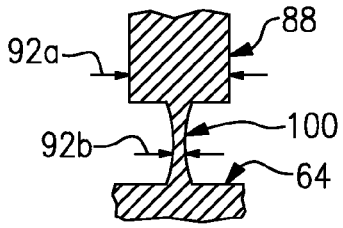
FIG. 5B shows an expanded view of a break-away joint connecting a damper member to an airfoil body.

FIG. 5A, FIG. 5B and FIG. 6 show the damper member 88 of the airfoil 60 in an as-manufactured condition, prior to breakage of the narrow protuberance 90. As can be seen in FIGS. 5A and 5B, the damper member 88 is initially rigidly connected to an interior wall of the cavity 78, such as an upper surface of the platform 64, in a break-away joint 100. The damper member 88 has a minimum cross-sectional area represented at 92*a* and the break-away joint 100 has a minimum cross-sectional area represented at 92*b*. The break-away joint 100 initially supports the damper member 88 within the cavity 78 such that the damper member 88 extends through the cavity 78. In this example, the damper member 88 is free of contact with any other structure within the cavity 78, exclusive the break-away joint 100, as depicted in FIG. 6.

The minimum cross-sectional area 92*b* of the break-away joint 100 is less than a critical cross-sectional area needed to support the mass of the damper member 88 during rotation of the airfoil 60 under normal engine operating conditions, such as cruise. Upon operation of the airfoil 60 to rotate around the engine central axis A, a pressure corresponding to the mass of the damper element 88 is exerted over the minimum cross-sectional area 92*b* of the break-away joint 100. Above the critical cross-sectional area, the break-away joint 100 would be able to support the mass of the damper member 88 and would not fracture. However, below the critical cross-sectional area, the mass of the damper member 88 exceeds the strength of the break-away joint 100 and the break-away joint 100 thus breaks, freeing the damper member 88 within the cavity 78. Upon fracture, the narrow protuberance 90 remains on the damper member 88 and the corresponding vestigial structure 94 remains on the interior wall of the cavity 78.

Figure 7:
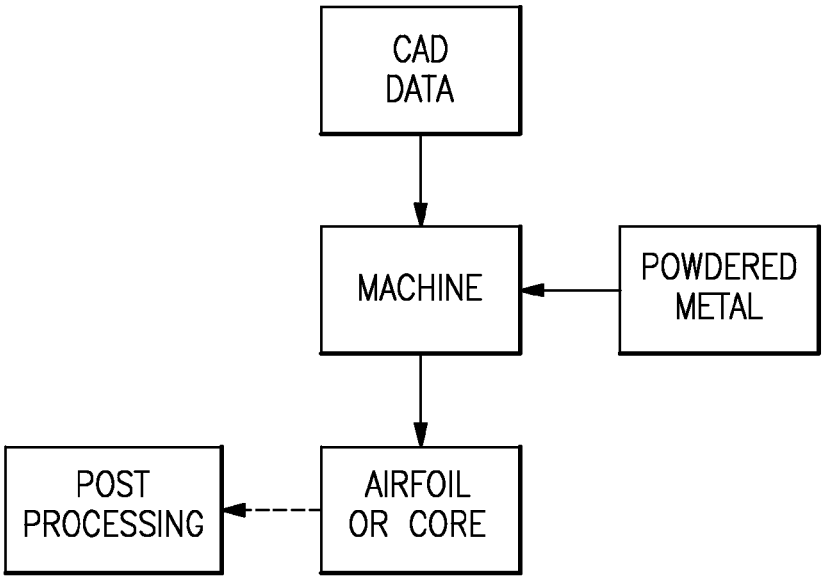
FIG. 7 shows an example method of processing an airfoil.

The geometries disclosed herein may be difficult to form using conventional casting technologies. Thus, a method of processing an airfoil having the features disclosed herein includes an additive manufacturing process, as schematically illustrated in FIG. 7. Powdered metal suitable for aerospace airfoil applications is fed to a machine, which may provide a vacuum, for example. The machine deposits multiple layers of powdered metal onto one another. The layers are selectively joined to one another with reference to Computer-Aided Design data to form solid structures that relate to a particular cross-section of the airfoil. In one example, the powdered metal is selectively melted using a direct metal laser sintering process or an electron-beam melting process. Other layers or portions of layers corresponding to negative features, such as cavities or openings, are not joined and thus remain as a powdered metal. The unjoined powder metal may later be removed using blown air, for example. With the layers built upon one another and joined to one another cross-section by cross-section, an airfoil or portion thereof, such as for a repair, with any or all of the above-described geometries, may be produced. The airfoil may be post-processed to provide desired structural characteristics. For example, the airfoil may be heated to reconfigure the joined layers into a single crystalline structure.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An airfoil comprising:

an airfoil body including a leading edge and a trailing edge and a first side wall and a second side wall that is spaced apart from the first side wall, the first side wall and the second side wall joining the leading edge and the trailing edge and at least partially defining a cavity in the airfoil body; and a damper member enclosed in the cavity, the damper member being free-floating within the cavity, wherein the damper member includes a vestigial joint structure and the airfoil body includes a corresponding vestigial joint structure.

2. The airfoil as recited in claim 1, wherein the damper member is elongated.

3. The airfoil as recited in claim 1, wherein the damper member has a geometric cross-sectional shape.

4. The airfoil as recited in claim 1, wherein the damper member includes a fractured surface at one end thereof.

5. The airfoil as recited in claim 1, wherein the damper member includes a terminal end and a narrow protuberance at the terminal end.

6. An airfoil comprising:

an airfoil body including a leading edge and a trailing edge and a first side wall and a second side wall that is spaced apart from the first side wall, the first side wall and the second side wall joining the leading edge and the trailing edge and at least partially defining a cavity in the airfoil body; and a damper member enclosed in the cavity, the damper member being connected to the body in a break-away joint, wherein the minimum cross-sectional area of the break-away joint is less than a critical cross-sectional area needed to support the mass of the damper member during rotation of the airfoil body.

7. The airfoil as recited in claim 6, wherein the break-away joint has a minimum cross-sectional area and the damper member has a minimum cross-sectional area, and the minimum cross-sectional area of the break-away joint is less than a minimum cross-sectional area of the damper member.

8. The airfoil as recited in claim 6, wherein the break-away joint is located at a terminal end of the damper member.

9. The airfoil as recited in claim 6, wherein the break-away joint is an exclusive connection between the damper member and the airfoil body.

10. The airfoil as recited in claim 6, wherein the damper member is free of any contact with the airfoil body, exclusive of the break-away joint.

11. A turbine engine comprising:

a compressor section;

a combustor in fluid communication with the compressor section; and a turbine section in fluid communication with the combustor, the turbine section being coupled to drive the compressor section and the fan, and at least one of the fan, the compressor section and the turbine section including an airfoil having an airfoil body including a body including a leading edge and a trailing edge and a first side wall and a second side wall that is spaced apart from the first side wall, the first side wall and the second side wall joining the leading edge and the trailing edge and at least partially defining a cavity in the body and a damper member enclosed in the cavity, the damper member being free-floating within the cavity, wherein the damper member includes a vestigial joint structure and the airfoil body includes a corresponding vestigial joint structure.

12. The turbine engine as recited in claim 11, wherein the vestigial structure of the damper member includes a fractured surface at one end thereof.

13. The turbine engine as recited in claim 11, wherein the damper member is elongated.

14. The turbine engine as recited in claim 11, wherein the damper member has a geometric cross-sectional shape.

15. A method for processing an airfoil, the method comprising:

depositing multiple layers of a powdered metal onto one another;

joining the layers to one another with reference to data relating to a particular cross-section of an airfoil; and producing the airfoil with a body including an airfoil body including a leading edge and a trailing edge and a first side wall and a second side wall that is spaced apart from the first side wall, the first side wall and the second side wall joining the leading edge and the trailing edge and at least partially defining a cavity in the airfoil body, and a damper member enclosed in the cavity, the damper member being connected to the body in a break-away joint, wherein the minimum cross-sectional area of the break-away joint is less than a critical cross-sectional area needed to support the mass of the damper member during rotation of the airfoil body.

16. The airfoil as recited in claim 1, wherein the vestigial structure of the damper member and the corresponding vestigial structure of the airfoil body each include a fractured surface.

17. The airfoil as recited in claim 16, wherein the vestigial structure of the damper member is a narrow protuberance located at a terminal end of the damper member.

18. The airfoil as recited in claim 16, wherein the vestigial structure of the damper member is located at a radially inboard end of the damper member.

19. The airfoil as recited in claim 16, wherein the fractured surfaces have topological features that are characteristic of a ductile break, a brittle break, or combination thereof.

* * * * *